US007870979B2

(12) United States Patent
Maki et al.

(10) Patent No.: US 7,870,979 B2
(45) Date of Patent: Jan. 18, 2011

(54) CONTAINER WITH A SCOOPABLE AND POURABLE SPOUT

(75) Inventors: James Maki, McHenry, IL (US); Jeffrey W. George, Cary, IL (US)

(73) Assignee: The Quaker Oats Company, Chicago, IL (US)

( * ) Notice: Subject to any disclaimer, the term of this patent is extended or adjusted under 35 U.S.C. 154(b) by 492 days.

(21) Appl. No.: 11/403,772

(22) Filed: Apr. 13, 2006

(65) Prior Publication Data

US 2007/0241141 A1 Oct. 18, 2007

(51) Int. Cl.
*B65D 25/40* (2006.01)

(52) U.S. Cl. ..... 222/570; 222/541.9; 222/566; 222/575; 220/254.1

(58) Field of Classification Search ..... 222/570, 222/566, 541.9, 544, 457.5, 541.6, 568, 575; 220/270, 254.1; 426/394
See application file for complete search history.

(56) References Cited

U.S. PATENT DOCUMENTS 3,899,107 A * 8/1975 Gaal ..... 222/570
4,606,481 A * 8/1986 Conti et al. ..... 222/562
4,993,603 A * 2/1991 Polhemus ..... 222/472
5,799,813 A * 9/1998 Letica ..... 220/254.1
5,806,710 A * 9/1998 Shiffer et al. ..... 220/785
6,059,153 A * 5/2000 Olson et al. ..... 222/465.1
6,279,788 B1 * 8/2001 Lillelund et al. ..... 222/481
6,412,661 B1 * 7/2002 Hannah, Sr. ..... 222/571
6,983,862 B2 * 1/2006 Nottingham et al. ..... 222/109
6,983,869 B1 * 1/2006 Stevens ..... 222/570
7,134,576 B2 * 11/2006 Gringer et al. ..... 222/570
2003/0121941 A1 * 7/2003 Walsh et al. ..... 222/465.1
2004/0026450 A1 * 2/2004 Rohr et al. ..... 222/109
2005/0092751 A1 * 5/2005 Alvares et al. ..... 220/270

* cited by examiner

*Primary Examiner*—Kevin P Shaver
*Assistant Examiner*—Jonathan Wood
(74) *Attorney, Agent, or Firm*—Banner & Witcoff, Ltd.

(57) ABSTRACT

A container for storing pourable contents having a cover with a spout wall upwardly extending from the top surface of the cover. The spout wall has a pouring section which gradually reduces in height to the front of the spout. On either side of the pouring section the spout wall also has a spill inhibiting section to prevent spilling as the contents of the container is poured. The container also has a removable lid which mates with the spout wall to prevent contents from spilling over the spout wall when the container is being used for dispensing.

16 Claims, 7 Drawing Sheets

CONTAINER WITH A SCOOPABLE AND POURABLE SPOUT

FIELD OF THE INVENTION

The invention relates generally to containers that include a spout for pouring contents therefrom, and more particularly for the pouring of solid material therefrom.

BACKGROUND OF THE INVENTION

Various food containers having pouring spouts are known. Spout blockages caused by product build-up at the spout can also be a problem.

A need exists for a food container and pouring spout having improved functionality and convenience. A need exists for a pouring spout that is particularly useful for the pouring of solid food products, especially flakes.

BRIEF SUMMARY OF THE INVENTION

This invention addresses the foregoing needs in the art by providing a container with an improved and novel pouring spout that may be used for pouring solid food materials, including flaked food materials while obtaining a relatively free flowing and accurate pour.

The present invention also provides a container that has an opening which enables access for scooping its contents, as well as efficiently pouring its contents into a targeted area, a food receiving receptacle. In one embodiment, a removable lid forms part of the container that can also function as a food receiving receptacle.

In one aspect, the present invention also provides a container that has a cover with a top surface inner portion that is removable and separable from an outer portion to provide a pouring and scooping opening that is surrounded by a spout wall. After the inner portion is removed, the container pouring and scooping opening can be covered with a removable lid which mates with the spout wall when the lid is in place on the container. This eliminates or minimizes unwanted spillage over the spout wall onto the outer portion of the cover, such as might occur if the container is tipped over during storage. Hence, when the lid is removed and the container is opened after tipping, contents are not scattered from the outer portion of the cover into the environment.

In one aspect of the invention a container for storing pourable contents has a body with a sidewall, a closed bottom end and a top end cover. The cover has a top surface with a portion having an opening to the interior of the container. The cover also has a spout wall upwardly extending from the top surface and positioned adjacent at least along a portion of the opening. The spout wall has a pouring section with a first end and a second end, and a front between the first and second ends of the pouring section. The spout wall has a first height at the first end of the pouring section and a second height at the second end of the pouring section. The spout wall has a height at the front that is less than the first height and second heights.

In another aspect of the invention the container has a spout wall that also includes a first spill inhibiting section connected to one side of said pouring section and extends away from the pouring section. The spout wall also has a second spill inhibiting section connected to the other side of the pouring section, also extending away from said pouring section. The first and second spill inhibiting sections inhibit the spilling of contents thereover. In one embodiment, the spill inhibiting section may be composed of a section of the spout wall that projects upwardly from the top surface of the cover to act as a dam. Thus, when the container is tilted to pour the contents from within the container and out the pouring section, the first and second spill inhibiting sections act to help prevent spilling of the contents from other than the pouring section.

In a further aspect of the invention the container is provided with a removable lid. The lid has an inner surface that sealingly mates with the top surface of the spout wall when the lid is mounted on the container. This arrangement provides a seal to help prevent the contents of the container from spilling over the spout wall when the container is in storage and not being used for pouring.

DETAILED DESCRIPTION OF THE INVENTION

Figure 1:
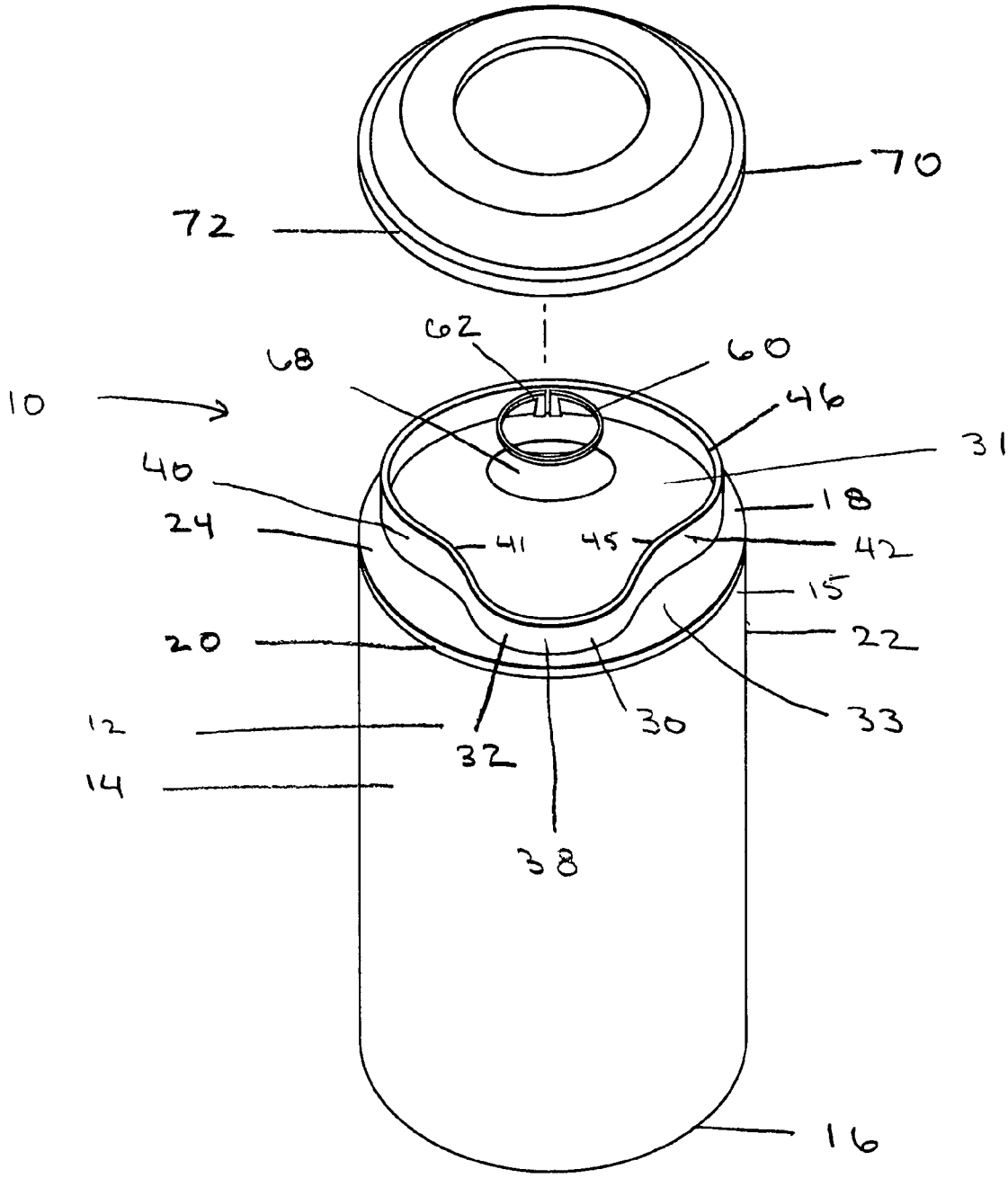
FIG. 1 is a perspective view of the container in accordance with the invention, prior to opening the top cover.
Figure 5:
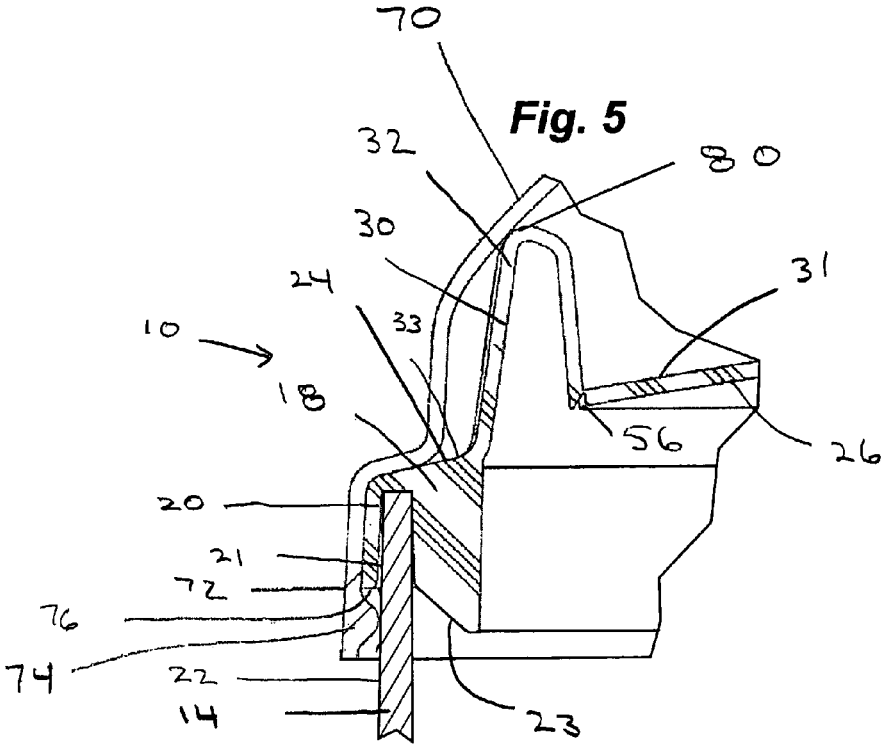
FIG. 5 is a fragmentary enlarged cross-sectional view showing the cover mounted to the container sidewall and the lid mounted to the cover.

Referring to the drawings generally, and in particular FIGS. 1 and 5, there is shown a container indicated generally as 10. Container 10 has a generally cylindrical body 12 with a sidewall 14, and a bottom end 16. Attached to the top end 15 of body 12 is a cover 18. Container 10 is filled with a product, such as oatmeal, cereals or any other pourable contents, prior to the mounting of cover 18 to top end 15 of container body 12. To facilitate attachment to container sidewall 14, cover 18 has a downward depending annular flange 20 positioned and secured to the outer surface 22 of body 12 adjacent to top end 15. Flange 20 has an annular recess 21 with a taper 23 to allow easy assembly of cover 18 and sidewall 14.

Top cover 18 has a slightly convex top surface 24 and an opposite bottom surface 26. Top surface 24 also is provided with an inner portion 31 and an outer portion 33. As discussed later in greater detail, inner portion 31 is removable from top 18 to provide an opening 28 for access to the contents within container 10. Appearing on top surface 24, and of particular importance to the present invention, is upstanding spout wall 30. Directing attention to FIGS. 2-4, spout wall 30 has a generally semicircular pouring section 32 extending from its first end 34 to its other end 36. Pouring section 32 also has a front 38 which is of a lesser height than the height of spout wall 30 as measured at ends 34, 36 of pouring section 32. It is noted that pouring section wall 32 gradually reduces in height, or tapers, when moving in a direction along pouring spout wall 30 from ends 34, 36 towards front 38.

Figure 2:
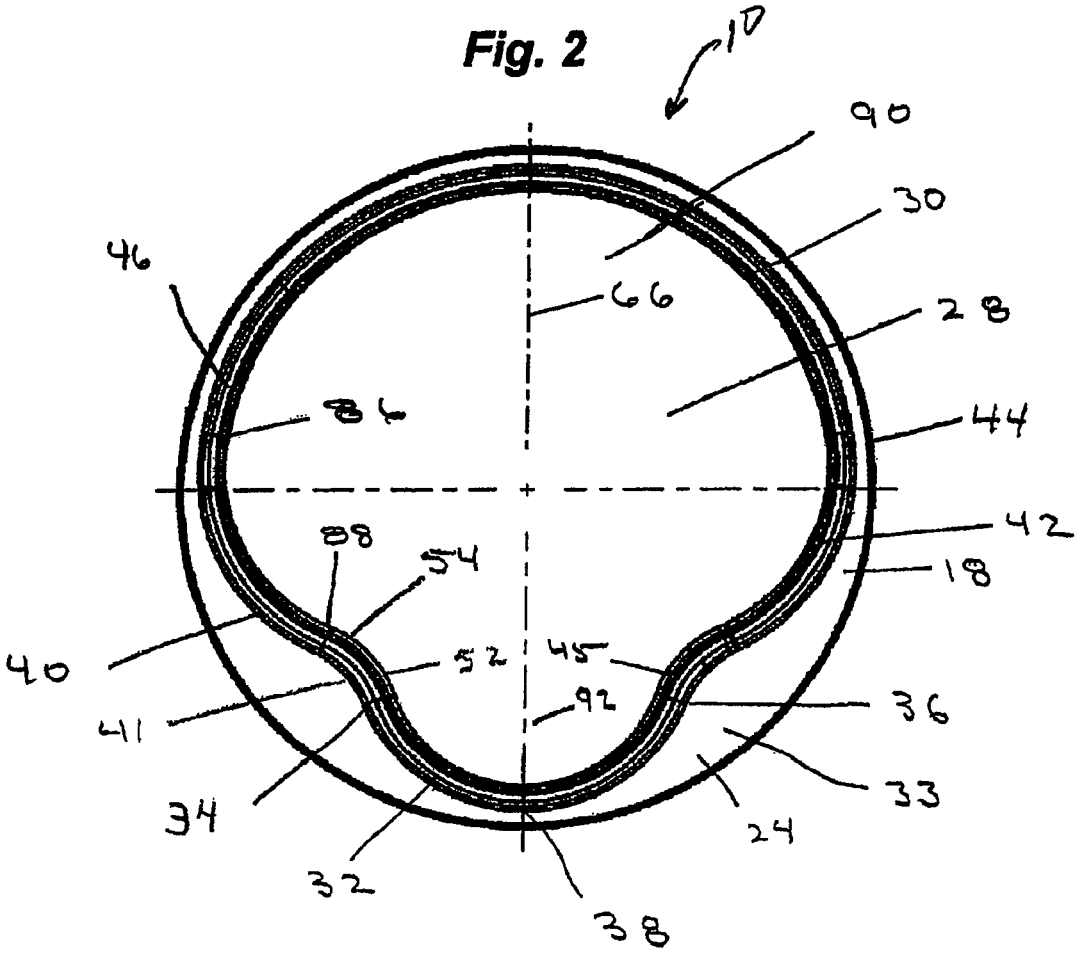
FIG. 2 is a is top plan view of the container of FIG. 1.

Flanking either side of pouring section 32 are spill inhibiting sections 40 and 42. Spill inhibiting section 40 extends generally laterally and somewhat rearward from end 34 of pouring section 32. Spill inhibiting section 40 also may include a transition section 41 which provides a transition from pouring section 32 to spill inhibiting section 40. Transition section 41 provides a transition for both spout wall height, as well as the spout wall configuration, between pouring section 32 and spill inhibiting section 40. As best seen in FIG. 2, spill inhibiting section 40 and pour section 32 have a generally arcuate shape about a center point that is interior of spout wall 30, while the generally arcuate shape of transition section 41 is about a center point that is outside the interior of spout wall 30. Thus, arcuate shaped transition section 41 faces the opposite direction of that of sections 32 and 40.

Transition section 41 also provides a transition of the function between the primary functions of pouring section 32 and spill inhibiting section 40. The direction of the configuration of the forward portion 52 of transitional section 41 cooperates with pour section 32 to provide a surface that directs the pour of contents towards front 38. The direction of the configuration of the rearward portion 54 of transition section 41, on the other hand, tends to cooperate with spill inhibitor section 40 to primarily perform a damming and spill inhibiting function. It is noted that the forward portion 52 may have a length that is approximately ½ of the length of transition section 41.

Transition section 41 also includes a point or apex 43 which provides the apex of the height of spout wall 30 as it projects from top surface 24. Between apex 43 and end 34 of pouring section 32, the height of transition section 41 gradually reduces. Moving along the opposite direction from apex 43 towards spill inhibiting section 40, the height of transition section 41 also gradually reduces. It can also be observed in FIGS. 3 and 4 that spill inhibiting section 40 also generally gradually reduces in height when moving along section 40 in a direction away from transition section 41 and pouring section 32. Spill inhibiting section 40 of spout wall 30 extends towards the periphery 44 of top surface 24 to merge with a rear section 46 of spout wall 30. Rear spout wall section 46 has a generally uniform height and is in a spaced relationship to top surface periphery 44.

In a like manner, on the other side of pouring section 32, a second spill inhibiting section 42 extends laterally and rearwardly from end 36 while gradually reducing in height to join with uniform height rear section 46 of spout wall 30. Also in a similar manner, a transition section 45 joins pouring section 32 to spill inhibiting section 42. Transition section 45 also has an arc facing opposite than that of pouring sections 32 and spill inhibiting section 42, as well as an apex point 47 of substantially the same height as that of apex 43.

It is noted that spout wall 30 defines the boundary between outer portion 33 of top surface 24 and its removable inner portion 31. To facilitate removal of inner portion 31, cover 18 is provided with an annular score line, or weakened fail portion, 56 adjacent the path of spout wall 30, as best seen in FIG. 5. Score line 56 may be provided on bottom surface 26 of cover 18, top surface 24 of cover 18, or both. In the preferred embodiment, score line 56 appears only on bottom surface 26 so as not to provide a crevice on top surface 24 within which foreign matter might accumulate to thereby create a potentially unsanitary condition.

Figure 7:
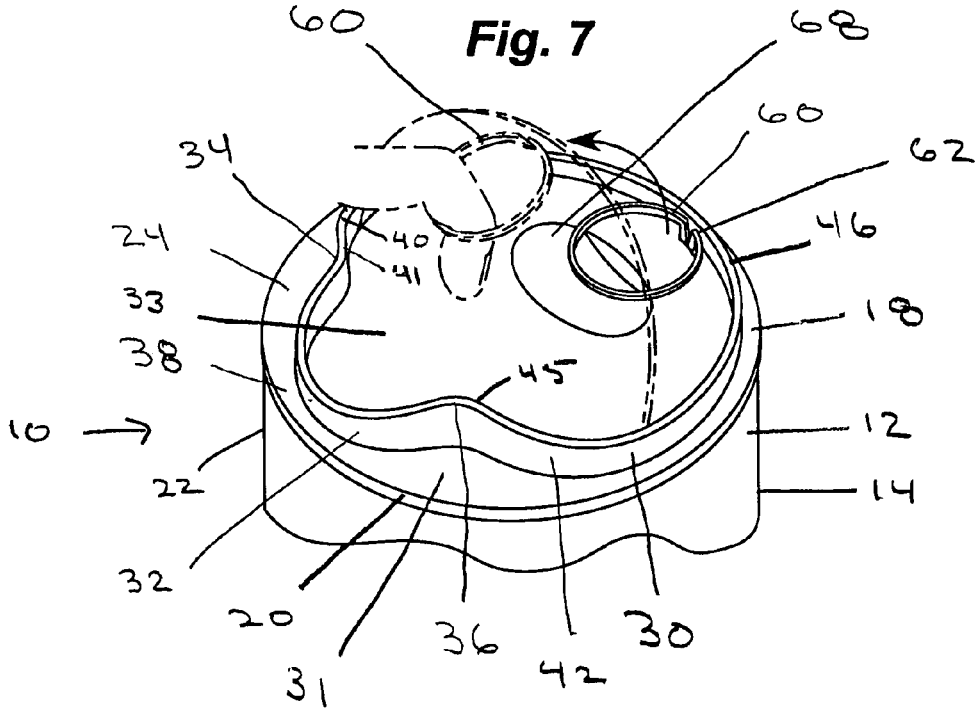
FIG. 7 is a partial perspective view of the container of FIG. 1 showing the inner portion of the cover being manually removed to open the container.

As seen in FIG. 7, a manual means for removal of inner portion 31 of cover 18 is provided by an integrally formed pull ring 60 connected to top surface of 24 of cover 18 by lugs 62. Lugs 62 also act to space pull ring 60 from top surface 24 and recessed area 68, to allow pull ring 60 to be easily accessed and grasped. Once grasped, the user pulls upward on ring 60 to first fracture the connection between inner portion 31 and outer portion 33 at score line 56 adjacent lugs 62. Thereafter, by continued pulling on ring 60 in an upward and forward direction, the remainder of score line 56 is fractured to fully separate inner portion 31 and outer portion 33. The removal of inner portion 31 provides opening 28 in cover 18.

A generally dome shaped lid 70 provides a seal for container 10 after inner portion 31 has been removed. As best viewed in FIG. 5, lid 70 has an annular flange 72 with a rib 74 appearing therearound. Rib 74 removably engages the bottom edge 76 of flange 20 when lid 70 is snapped onto container 10 to seal container 10 when not in use. Flexible annular flange 72 of lid 70 can be pried away from flange 20 of cover 18 to disengage rib 74 from edge 76 to allow removal of lid 70, and provide access to the contents of container 10 through opening 28.

Figure 6:
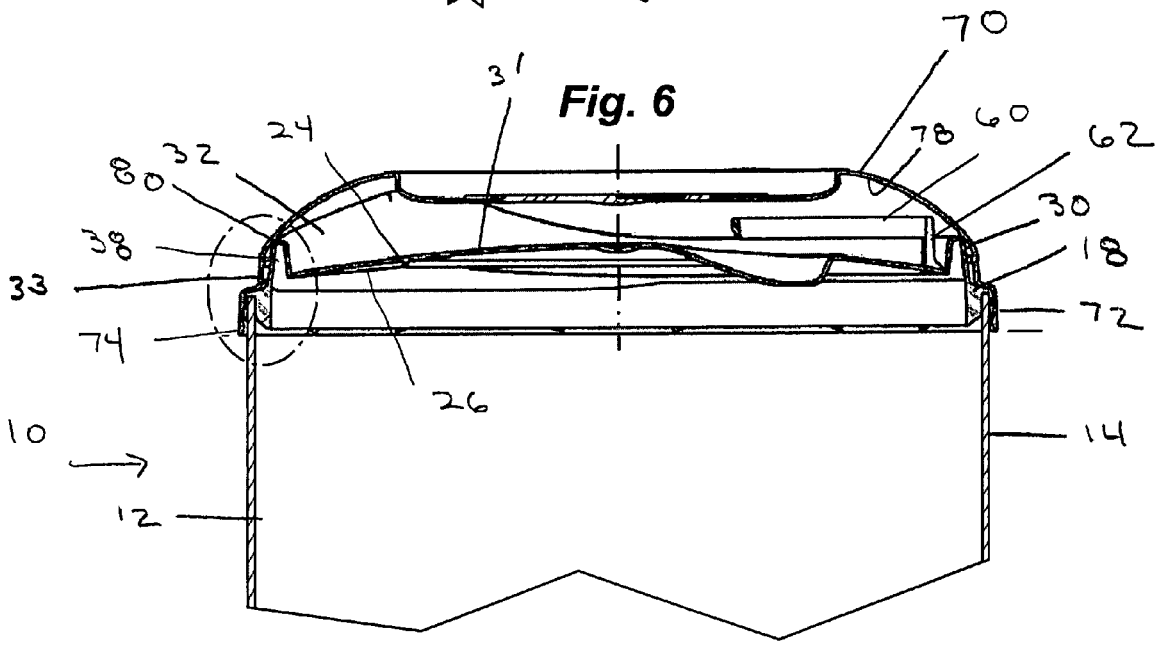
FIG. 6 is a fragmentary cross-sectional view showing the cover mounted to the container sidewall and the lid mounted to the cover.
Figure 9:
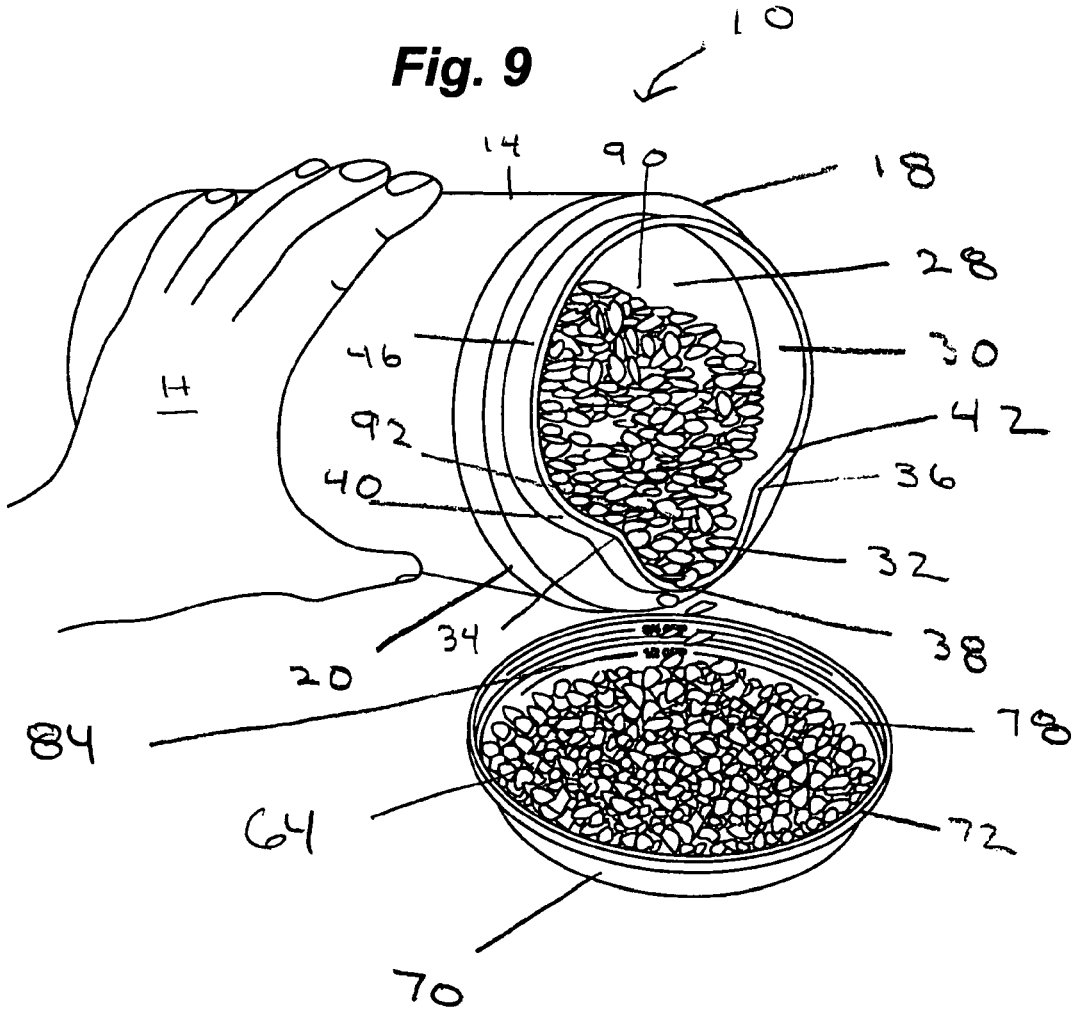
FIG. 9 is a perspective view of the container of FIG. 1 showing contents being poured from the container.
Figure 10:
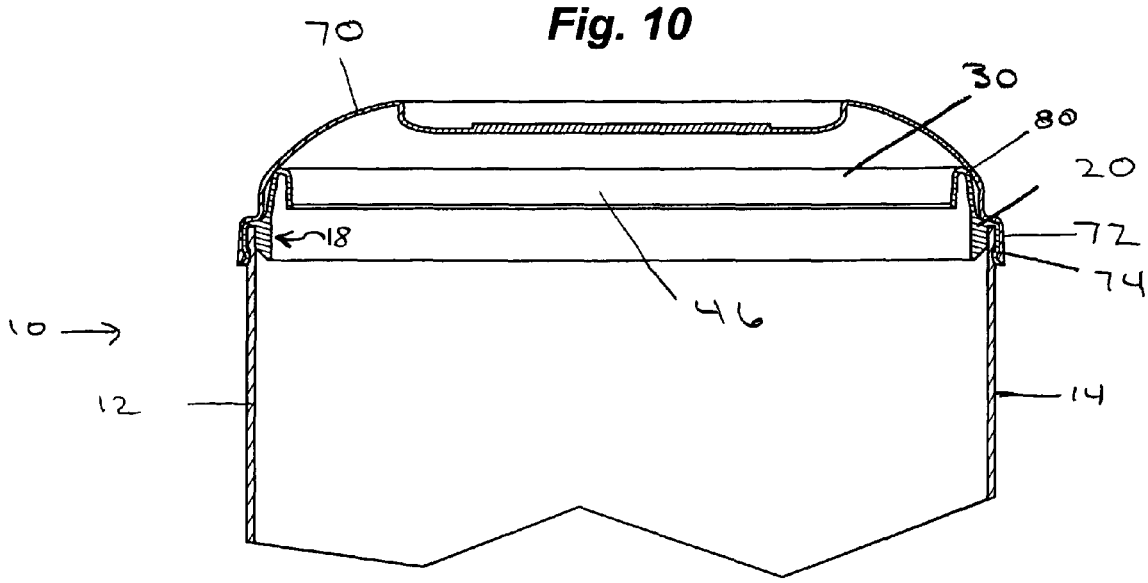
FIG. 10 is a fragmentary cross-sectional view of the container of FIG. 1 showing the lid in position over the container opening.

Referring now to FIGS. 5, 6, and 9, also of particular interest to the present invention, is the mating of the inner surface 78 of lid 70 and the top surface 80 of spout wall 30 when lid 70 is secured in place on container 10. It is noted that the contour of inner surface 78 of lid 70 is such that inner surface 78 contacts the top surface 80 of spout wall 30. This includes all of rear section 46, and substantial portions of spill inhibiting sections 40, 42, transition sections 41 and 45 and pouring section 32.

The mating between inner surface 78 and top surface 80 of spout wall 30 acts to seal opening 28. This prevents unintended passage of the contents from the interior of container 10 to outer portion 33 of top surface 24 when lid 70 is on container 10. Thus, for example, if container 10 tips over while being stored, contents are less likely to be spilled onto outer portion 33. If this were to occur, such contents would spill from the outer portion into the environment when lid 70 is later removed.

Figure 8:
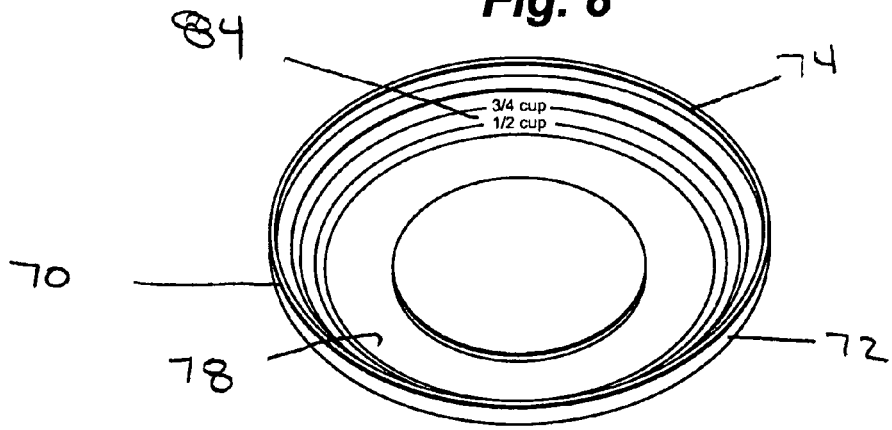
FIG. 8 is a perspective view of the removed lid of the container of FIG. 1.

The interior surface 78 of lid 70 may also include indicia such as markings 84 so that lid 70 can be utilized as a measuring device. For example, as shown in FIGS. 8 and 9, markings of ½ cup and ¾ cup are provided so that the user has a ready means for the dispensing of a desired amount of the contents. Thus, container 10 of the present invention is particularly useful for grasping a hand H and pouring out cereals, such as traditional oatmeal flakes 64, where a recipe calling for a set amount of oatmeal is followed during preparation of the meal.

It was found that with a container 10 that has an opening 28 of the configuration shown in FIG. 2, but without a spout wall 30, it is difficult to accurately pour the flakes into a relatively narrow width lid 70 without at least some flakes being spilled outside lid 70. It was also discovered that for accurate pouring, spout 30 preferably is configured with a number of specific features to optimize the pouring flow, while at the same time minimizing spilling. For example, by narrowing the configuration of pouring section 32, an attempt was made to concentrate the flow to obtain increased control of the flow direction. It was observed for dispensing traditional sized oat flakes 64, that if pouring section 32 was narrowed even a seemingly relatively small amount, the flow of oat flakes was noticeably restricted, and tended to be more prone to 'log jamming'.

It was also discovered that without the reduction of height in front 38 of pouring section 32, the oat flakes would tend to pile up at the front of such unreduced height. This inhibited the flow of the contents out of spout pouring section 32. As a result, the user tended to increase the pouring angle in order to obtain a flow, which in turn resulted in oats flowing over spill inhibitors 40 and 42 landing outside of the intended target lid 70.

Figure 3:
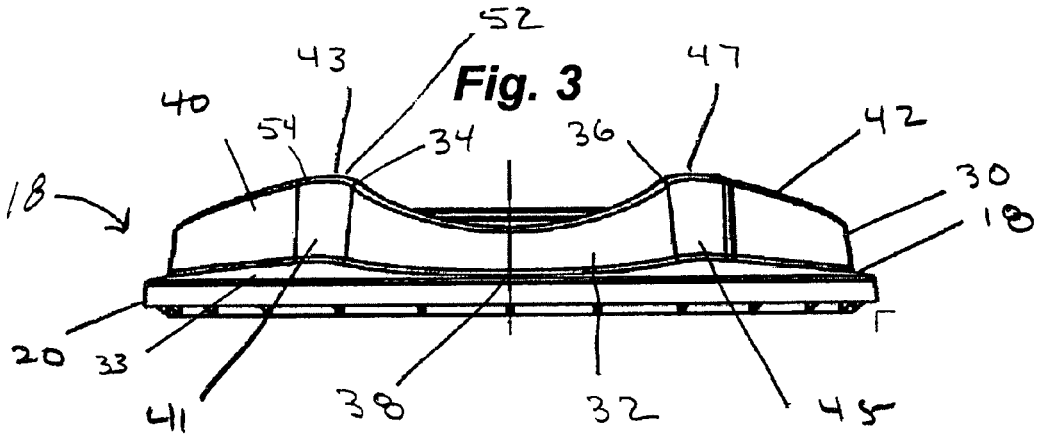
FIG. 3 is a front plan view of the spout wall and container cover of the container of FIG. 1.
Figure 4:
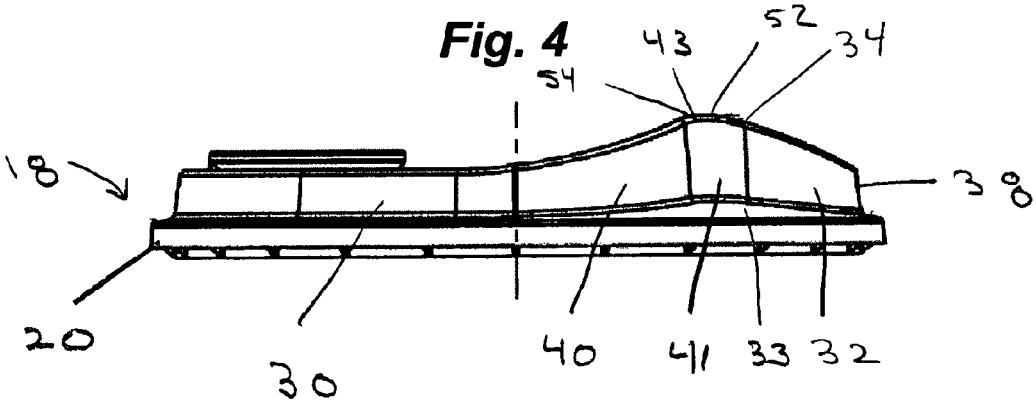
FIG. 4 is side plan view of the spout wall and container cover of FIG. 3.

Container cover 18 with the opening 28 configuration shown in FIGS. 2-4, on the other hand, exhibited excellent pouring characteristics for oat flakes. While possibly not fully understanding the dynamics of the pouring oat flakes, it is believed that the generally semi-circular configuration and size of pouring section 32, as well as the lower profile height of front 38, combines to overcome the tendency of 'log jamming' and thereby allow a consistent flow. For example, a pouring section 32 radius of approximately 1 inch, and a width between apexes 43, 47 of approximately 2.5 inches, provides a desired flow with good directional control and reduced tendency to 'logjam'.

It is further noted that spill inhibiting sections 40, 42 extend both laterally and rearwardly from pouring section 32. If spill inhibiting sections 40, 42 only extended in a lateral direction from ends 34, 36, i.e., if spill inhibiting sections 40, 42 are at a 900 angle to a line 66 bisecting opening 28 and passing through front 38, a damming effect is accomplished, but the flow of oats becomes somewhat restricted. Therefore, in the preferred embodiment it is noted that spill inhibiting sections 40, 42 are angled toward the pouring section 32 so that spill inhibiting sections 40, 42 not only provide a damming effect, but additionally act to channel the flakes towards the pour section 32 to provide a consistent free flowing pour.

In this regard, it is noted that the chord taken along the length of arcuate shaped spill inhibiting sections 40 and 42 forms an angle of approximately 45° with line 66 bisecting opening 28 and passing through front 38. It is preferred that such angle be in the approximate range of 30°-55° in order to get at least some adequate level of both a damming action and a flow directing effect of the flakes towards pouring section 32.

For reference, the chord referred to above is taken along the entire length of a spill inhibiting section 40, such as between point 86 and point 88.

If, for example spill inhibiting sections 40, 42 and transition sections 41, 45 are formed as a generally straight line, rather than as an arc, spill inhibiting section 408 and transition section 41 would also be positioned at an angle with line 66 bisecting cover 18 and passing through front 38, that is, in the same 30°-55° range. Whether a of straight line or the preferred arcuate shape, spill inhibiting sections 40, 42 of the present invention act to both dam and to direct the flow of oats out opening 28 without spilling outside the intended target area.

It is noted that opening 28 also includes a portion providing a scooping section opening 90 rearward of the portion providing a pouring section opening 92. Scooping section opening 90 has a greater cross section area than that of pouring section opening 92 to allow a convenient access to the contents by a spoon or other utensil. This gives the user an option as to whether to dispense contents by pouring or scooping through opening 28. For example, the cross sectional area of scooping section opening 90 may be 75%, or greater, than the cross sectional area of opening 28, with the remainder of the area of opening 28 providing pouring opening section 92.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

Modifications may be made to the embodiments described above without departing from the broad inventive concepts thereof. Accordingly, the present invention is not limited to the particular embodiments nor to the theoretical description disclosed, but is intended to cover all modifications that are within the spirit and scope of the invention as defined in the appended claims.

The invention claimed is:

1. A container for storing pourable contents therein comprising:

a body, said body having a sidewall, a closed bottom end and a top end cover, said cover having a top surface, said top surface having a portion with an opening to the interior of said container, a spout wall upwardly extending from said top surface and positioned adjacent to at least a portion of said opening, said spout wall not extending beyond the perimeter of the sidewall, said spout wall having a pouring section, said pouring section having a first end and a second end and a front between said first and second ends of said pouring section, said spout wall having a first height at said first end of said pouring section and a second height at said second end of said pouring section, and said spout wall having a height at said front that is less than said first height and less than said second height;

wherein said spout wall has an upwardly extending first spill inhibiting section connected to said first end of said pouring section, said first spill inhibiting section extending laterally and rearwardly away from said pouring section, wherein the height of the first spill inhibiting section gradually reduces when moving away from the pouring section, and said spout wall having an upwardly extending second spill inhibiting section connected to said second end of said pouring section, said second spill inhibiting section extending laterally and rearwardly away from said pouring section, wherein the height of the second spill inhibiting section gradually reduces when moving away from the pouring section, said first and second spill inhibiting sections inhibiting the spilling of contents thereover, so that when said container is tilted to pour said contents from within said container and out said pouring section, said first and second spill inhibiting sections act to help prevent spilling of said contents from other than said pouring section;

wherein said spout wall includes a first and a second transition section, said first transition section connecting said first spill inhibiting section with said first end of said pouring section, and said second transition section connecting said second spill inhibiting section with said second end of said pouring section; wherein the first and second spill inhibiting sections and the pouring section have a generally arcuate shape about a center point that is interior of the spout wall, while the first and second transition sections have an arcuate shape that is about a center point that is outside the interior of the spout wall such that the arcuate shaped first and second transition sections face opposite the direction that the first and second spill inhibiting sections and the pouring section face.

2. The container of claim 1 wherein said spout wall pouring section includes a first tapered portion joining said first end of said pouring section to said front, and a second tapered portion joining said second end of said pouring section to said front, said first tapered portion of said pouring section having a height that generally gradually reduces as said tapered portion extends from said first end of said pouring section towards said front, and said second tapered portion of said pouring section having a height that generally gradually reduces as said second tapered portion extends from said second end of said pouring section towards said front.

3. The container of claim 2 wherein said opening of said container includes a pouring area opening and a scooping area opening, said pouring area opening defined in part by said spout wall along said pouring section, and said scooping area opening defined at least in part by said first and second spill inhibiting sections, said scooping area opening being larger than said pouring area opening and adapted to allow scooping of said contents from said container.

4. The container of claim 3 wherein said pouring section of said spout wall has a generally semi-circular shape.

5. The container of claim 4 wherein said pouring section has a radius of approximately 1 inch.

6. The container of claim 3 wherein said opening of said container has a first cross sectional area and said scooping area opening has a second cross sectional area, said second cross sectional area being approximately 75% of first cross sectional area.

7. The container of claim 2 wherein said top end cover includes a bottom surface opposite said top surface of said cover, said cover having an annular fail portion disposed in one of said top and bottom surfaces of said cover, said top surface of said cover having an inner portion and an adjacent outer portion defined by said fail portion, said fail portion providing a weakening in said cover so that said inner portion of said cover may be removed from said cover along said fail portion to provide said opening to the interior of said container.

8. The container of claim 7 wherein said container includes a pull ring attached to said inner portion for separating said inner portion from said outer portion.

9. The container of claim 1 wherein said container has a lid, said lid including an inner surface, said lid removably mounted on said container, and when so mounted, said inner surface of said lid mating with said spout wall along at least a portion of said spout wall when said lid is mounted on said container to provide a seal to thereby inhibit contents of said container from spilling over said spout wall.

10. The container of claim 9 wherein said spout wall is continuous around said top surface of said cover and said spout wall has a top surface, said lid mating with said top surface of said spout wall when said lid is mounted on said container.

11. The container of claim 1 wherein said spill inhibiting section extends generally along a line forming an angle between about 30° to about 55° with a line bisecting the container top cover and said pouring section.

12. The container of claim 11 wherein said angle is approximately 45°.

13. The container of claim 11 wherein said container includes a lid, said lid having an opening and an inner surface, said lid having a rib extending from said inner surface adjacent said lid opening, said cover including a flange for mounting said cover to said container sidewall, said lid removably mountable on said container and secured thereto by said rib engaging said cover flange, said inner surface of said cover lid in sealable engagement with said spout wall when said lid is mounted on said container.

14. A cover for covering the open end of a container having a sidewall for containing and pouring contents from said container, said cover comprising: an upper surface and a lower surface, said cover having a portion which is removable therefrom to form an opening extending through said cover, a spout wall upwardly extending from said upper surface and positioned adjacent at least a portion of said opening, said spout wall not extending beyond the perimeter of the sidewall, said spout wall having a pouring section, said pouring section having a first end and a second end and a front between said first and second ends of said pouring section, said spout wall having a first height at said first end of said pouring section and a second height at said second end of said pouring section, and said spout wall having a height at said front that is less than said first height and less than said second height;

wherein said spout wall has an upwardly extending first spill inhibiting section adjacent said first end of said pouring section, said first spill inhibiting section extending laterally and rearwardlv away from said pouring section, wherein the height of the first spill inhibiting section gradually reduces when moving away from the pouring section, and said spout wall having an upwardly extending second spill inhibiting section adjacent said second end of said pouring section, said second spill inhibiting section extending laterally and rearwardlv away from said pouring section, wherein the height of the second spill inhibiting section gradually reduces when moving away from the pouring section, said first and second spill inhibiting sections inhibiting the spilling of contents thereover, so that when said container is tilted to pour said contents from within said container out of said pouring section, said first and second spill inhibiting sections act to help prevent spilling of said contents from other than said pouring section;

wherein said spout wall includes a first and a second transition section, said first transition section connecting said first spill inhibiting section with said first end of said pouring section, and said second transition section connecting said second spill inhibiting section with said second end of said pouring section; wherein the first and second spill inhibiting sections and the pouring section have a generally arcuate shape about a center point that is interior of the spout wall, while the first and second transition sections have an arcuate shape that is about a center point that is outside the interior of the spout wall such that the arcuate shaped first and second transition sections face opposite the direction that the first and second spill inhibiting sections and the pouring section face.

15. The cover of claim 14 wherein said spout wall pouring section includes a first tapered portion joining said first end of said pouring section to said front portion, and a second tapered portion joining said second end of said pouring section to said front, said first tapered portion of said pouring section having a height that generally gradually reduces as said tapered portion extends from said first end of said pouring section towards said front, and said second tapered portion of said pouring section having a height that generally gradually reduces as said second tapered portion extends from said second end of said pouring section towards said front.

16. The cover of claim 15 wherein said spill inhibiting sections extend generally along a line forming an angle between about 30° to about 55° with a line bisecting the container top cover and passing through said front of said pouring section.

* * * * *